US005751238A

United States Patent [19]

Lin

[11] Patent Number: 5,751,238

[45] Date of Patent: May 12, 1998

[54] ACTIVE CORNER REFLECTOR

[75] Inventor: David M. Lin, Beavercreek, Ohio

[73] Assignee: The United States of America as represented by the Secretary of the Air Force, Washington, D.C.

[21] Appl. No.: 716,701

[22] Filed: Sep. 19, 1996

[51] Int. Cl.[6] ..... H01Q 15/20

[52] U.S. Cl. ..... 342/5; 342/7; 342/8; 342/10; 342/187

[58] Field of Search ..... 342/5, 6, 7, 8, 342/9, 10, 187

[56] References Cited

U.S. PATENT DOCUMENTS

| | | | |
|---|---|---|---|
| 3,337,807 | 8/1967 | Brown | 325/429 |
| 3,621,465 | 11/1971 | Beaty | 331/107 |
| 3,685,050 | 8/1972 | Cartwright | 342/6 |
| 3,883,809 | 5/1975 | Ver Planck | 325/429 |
| 3,986,152 | 10/1976 | Howell | 333/80 |
| 4,005,418 | 1/1977 | Gorwara | 342/187 |
| 4,083,004 | 4/1978 | Cohn | 342/13 X |
| 4,117,485 | 9/1978 | Gorr et al. | 342/6 |
| 4,178,596 | 12/1979 | Rowlett | 342/187 |
| 4,357,611 | 11/1982 | Skomal | 342/9 |
| 4,612,543 | 9/1986 | DeVries | 342/187 |
| 4,723,123 | 2/1988 | Marlow et al. | 342/6 |
| 5,260,820 | 11/1993 | Bull et al. | 342/9 X |
| 5,319,373 | 6/1994 | Maxwell et al. | 342/55 |
| 5,508,704 | 4/1996 | Hann | 342/6 |

*Primary Examiner*—John B. Sotomayor
*Attorney, Agent, or Firm*—Gina S. Tollefson; Thomas L. Kundert; Gerald B. Hollins

[57] ABSTRACT

An apparatus and method for providing small size, high gain corner reflection of radio frequency signals for use in military and commercial applications. Conventional corner reflector practice is combined with electronic amplifying reflection devices such as the superregenerative amplifier to provide an array of antennas and amplifiers spread over each planar surface of a corner reflector. The specific antenna used may be selected from a plurality of various antenna types depending on the application. As in a conventional corner reflector, the amplified signal is reflected at the same angle and in the opposite direction of the incident signal.

12 Claims, 2 Drawing Sheets

ACTIVE CORNER REFLECTOR

RIGHTS OF THE GOVERNMENT

The invention described herein may be manufactured and used by or for the government of the United States for all governmental purposes without the payment of any royalty.

BACKGROUND OF THE INVENTION

This invention relates to the combination of a radio frequency corner reflecting antenna and solid state high gain amplification device.

A conventional corner reflector is made up of two or three mutually intersecting conducting surfaces. Corner reflectors are generally constructed from a solid or perforated sheet. The conventional corner reflector is useful in obtaining signal gains of the order of 12 dB. Higher gains can be obtained by using larger reflectors.

Accordingly, use of the conventional corner reflector for high gain is impractical in space limited applications. An active corner reflector consists of a primary radiating element such as a dipole and a dihedral corner reflector formed by the elements of the reflector. High gains can be obtained by using larger reflectors and larger spacing of the dipole to panel intersection. A corner reflector antenna reflects signals at the same angle and in the opposite direction as the incident beam angle. Based on this feature, the corner reflector has the capability of predictably reflecting signals almost regardless of the angle of incident beam reception. The corner reflector has been used as a radar beacon to help radars to track small targets. In the electronic countermeasures community, it has also been used as a passive decoy to deceive threat systems.

The present invention achieves the goal of decreasing the size of a corner reflector while at the same time predictably reflecting signals at high gain using reflecting electronic amplification devices. A superregenerative amplifier is one example of a device incorporating the reflection amplifier concept that is particularly suitable for use in a corner reflector. Superregeneration provides a simple means of obtaining a very large amount of radio frequency amplification at frequencies that are otherwise difficult to amplify. Superregeneration is described in U.S. Pat. Nos. 3,621,465 and 3,883,809 which are hereby incorporated by reference herein.

SUMMARY OF THE INVENTION

The present invention provides for the combination of a corner reflector antenna and electronic amplifier reflection device with minimal size and high gain.

It is an object of the present invention to provide a small size corner reflector for use in space limited operations.

It is another object of the present invention to provide a corner reflector with high gain.

It is another object of the present invention to provide a corner reflector with high gain that can be conveniently carried by a person.

It is another object of the present invention to provide a corner reflector with high gain that can be easily concealed by a person carrying it.

It is another object of the present invention to provide a corner reflector capable of multiple amplifications.

It is another object of the present invention to provide a corner reflector with multiple antenna configurations.

It is another object of the present invention to provide a back plane for a corner reflector surface element such that the electronic amplification device mounted thereon is removed from the field of the antenna to avoid effecting the patterns of the antenna and avoid device exposure to radiation.

It is another object of the present invention to provide a back plane to a corner reflector such that the source powering the electronic amplification device is mounted thereon and is out of the field of the antenna and avoids exposure to radiation.

These and other objects of the present invention are achieved by an active, high gain radio frequency corner reflecting apparatus comprising:

- a first planar surface, a second planar surface, and a third planar surface, said surfaces intersecting to define a concave vortex point and thereby further defining internal and external sides of each said planar surface;
- a plurality of transmitting and receiving antennas disposed on the internal side of one planar surface;
- a plurality of radio frequency signal amplifying electronic circuit chips coupled to each of said antennas; and
- a power source connected with each of said electronic circuit chips.

Additional objects and features of the invention will be understood from the following description and claims and the accompanying drawings.

DETAILED DESCRIPTION

Figure 1:
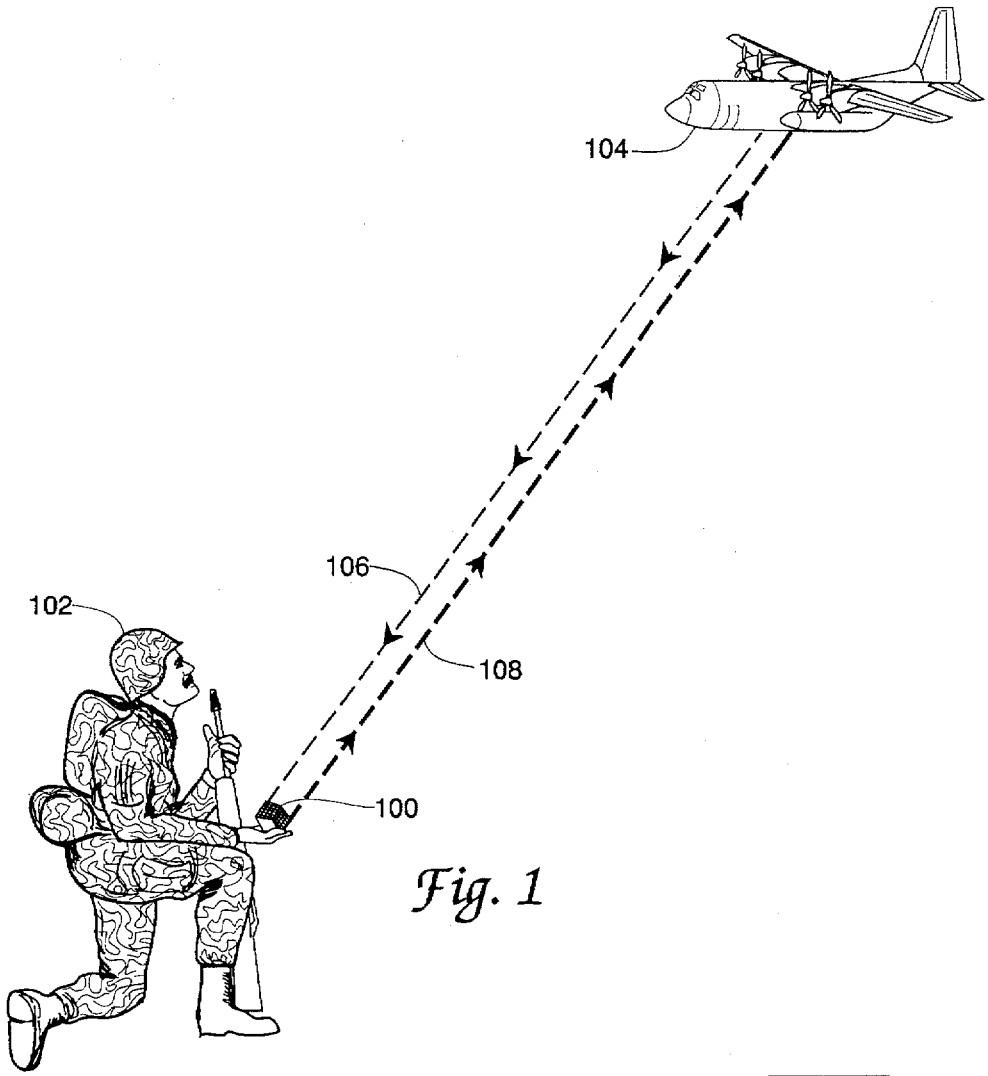
FIG. 1 shows an active corner reflector in accordance with the invention in use by a downed airman.

FIG. 1 of the drawings shows an active corner reflector 100 being held by a downed soldier 102 while an overhead aircraft 104 sends a radio frequency signal 106 to locate the soldier 102 and the active corner reflector 100 subsequently reflects an amplified radio frequency signal 108 back to the overhead aircraft 104 identifying the soldier's presence and location. The FIG. 1 active corner reflector configuration can be varied for specific applications. For example, an ergonomically pleasing, perhaps a foldable pyramid shaped, corner reflector can be made for ease of hand carrying. Alternatively, a flatter corner reflector could be made for combat missions where it would be primarily concealed.

Figure 2:
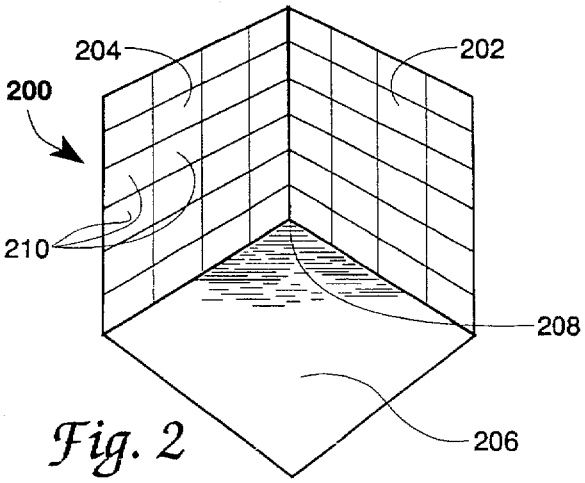
FIG. 2 shows a three-planed corner reflector.

FIG. 2 of the drawings shows details of a three-planed corner reflector 200. The first planar surface 202 intersects with a second planar surface 204 and the first and second planar surfaces intersect with a third planar surface 206 forming a recessed corner or vortex point 208. As a result of forming the corner or vortex point 208 the planar surfaces also define internal and external sides of a pyramidal surface. The internal side of planar surfaces 202 and 204, for example, may be host to a plurality or an array of electronic amplifying devices which are represented by the rectangles shown at 210. An array of superregenerative amplifiers is provided on each planar surface. An antenna, superregenerative amplifier and power source may also be mounted on the internal side of a planar surface. Alternatively, an antenna may be mounted on an internal surface of a corner reflector and the superregenerative amplifier and power source may be mounted on the external side of any one planar surface. Alternatively, an antenna and superregenerative amplifier may be mounted on the internal surface of a corner reflector and the power source could be mounted on the external side of any one planar surface. Alternative configurations would depend on the environment of the specific application and the requirement to shield any of the components.

Figure 3:
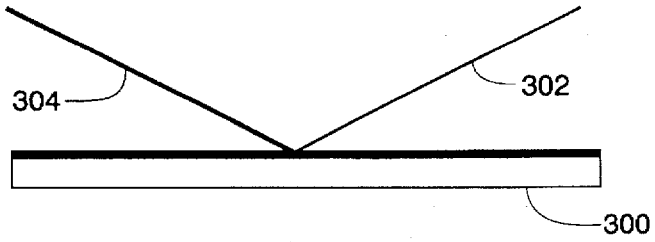
FIG. 3 is a drawing representation of a signal amplified by an electronic amplification device.
Figure 4:
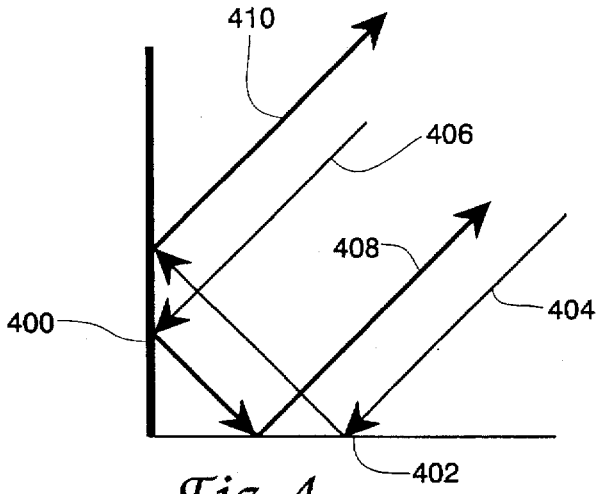
FIG. 4 is a drawing representation of signals being amplified and reflected in accordance with the invention.

FIGS. 3 and 4 of the drawing show a diagrammatic representation of the operation of the electronic amplifying devices of the corner reflector in accordance with the invention. FIG. 3 shows a radio frequency signal 302 being communicated to an electronic amplifying device 300. The reflected beam 304 is amplified in accordance with the parameters of the amplifying device. The equal angles of signal incidence and refraction shown in FIG. 3 are not specifically provided for in the FIG. 3 structure. When the FIG. 3 apparatus is embodied in the full corner reflector structure represented in FIGS. 2 and 4 however, the surrounding reflection surfaces of the corner reflector device tend to provide this equal angle of incident and refraction property. This property of course occurs in the known passive corner reflector and is represented in the FIG. 1 and FIG. 4 drawings herein.

FIG. 4 therefore further shows radio frequency signals 404 communicating to a first planar surface 402 of a corner reflector and then further communicating to a second planar surface 400 of the corner reflector wherein amplification of the signal occurs at the second planar surface and the signal 410 is subsequently reflected at the same angle as the incident signal angle and in the opposite direction thereof. The high directivity of the corner reflector can be useful in identifying missing soldiers as friend or foe. Radio frequency signal 406 operates similar to signal 404 as described, however, amplification occurs at the first planar surface encountered instead of the second planar surface. The drawing depicts amplification at only one of the three planar surfaces, however, amplification could occur at two or three planar surfaces.

Figure 5:
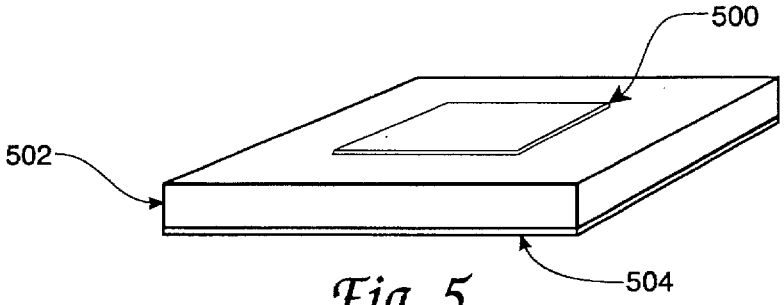
FIG. 5 shows a microstrip element antenna.

FIG. 5 shows an embodiment of the invention antenna wherein the antenna element for transmitting and receiving radio frequency signals in a corner reflector setting is a microstrip element 500. The preferred microstrip element consists of a rectangular conductor 500 that is photoetched from one side of a double-sided printed circuit board 502 with the opposite double side providing a metal ground plane 504. Use of a microstrip element antenna allows for a small, light-weight corner reflector such as the hand held type shown in FIG. 1.

Figure 6:
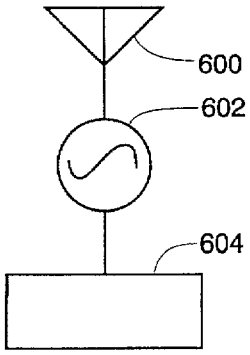
FIG. 6 shows a diagrammatic representation of a superregenerative amplifier.

A reflection amplifying device that is particularly suited for use in active corner reflectors is the superregenerative amplifier, shown diagrammaticly in FIG. 6. Generally, the superregenerative amplifier system includes an oscillator 602 and a quenching circuit (keyer) 604 which are connected to a single transmit/receive antenna 600. A superregeneration amplifier operates using alternating amplification and oscillations that build up and are quenched at a superaudible rate to provide signal gain in excess of 80 dB. The quenching circuit turns or keys the amplifier/oscillator on and off periodically. In the absence of an input signal, the oscillator starts up from noise each time it is keyed on. Therefore, the phase of the oscillations is random from pulse to pulse making the pulse train noncoherent. If an input signal is present which is larger than the noise, priming or superregenerative amplification occurs. The oscillator startup is then controlled by the input signal instead of the noise, and the oscillation will be in phase with the start of each pulse. This makes the pulse train coherent. Furthermore, the antenna 600 and the superregenerative amplifier is all that is required for a complete amplification device according to the present invention and both can be co-located on the same substrate. This feature lends itself to a miniature size capable of being hand held or easily concealed. This feature also lends itself to high volume and low cost production.

An IMPATT diode is one type of amplifier/oscillator device that could be used in the FIG. 6 superregenerative amplifier. The term IMPATT is actually an acronym meaning avalanche transit time effect of a read diode. The IMPATT diode is usually fabricated as a pn-junction diode operated with heavy back bias so that avalanche breakdown occurs in the active region. To prevent burnout, the device is so constructed that the active region is very close to a good heat sink. For the same reason, the bias supply must be a constant current type. These requirements can be accommodated in electrical circuitry which is part of the amplifying device 706 in the present apparatus.

Figure 7:
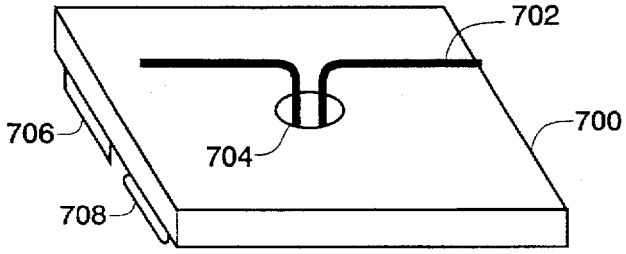
FIG. 7 shows a 3-dimensional view of one planar surface of an active corner reflector in accordance with the invention.

Another embodiment of the invention is shown in FIG. 7 where the antenna for transmitting and receiving radio frequency signals in each of the rectangles 210 of FIG. 2 is a dipole. The dipole element 702 is provided on the internal side of a planar surface 700. Any configuration of small antenna less than 1.5 cm may be used including the illustrated patched antenna or a single conductor elemented dipole, and this flexibility adds to the usefulness of the active corner reflector in varied applications. FIG. 7 also shows an electronic amplifying device 706 and a battery 708 located on the external side of the planar surface with the dipole, antenna 702 connected to the electronic amplifying device and battery through a passage 704 in the planar surface 700.

While the apparatus and method herein described constitute a preferred embodiment of the invention, it is to be understood that the invention is not limited to this precise form of apparatus or method and that changes may be made therein without departing from the scope of the invention which is defined in the appended claims.

I claim:

1. A portable, pocket carried, active, high gain radio frequency corner reflecting apparatus comprising:

a portable and collapsible three-dimensional structure having an assembled uncollapsible state thereof, said three-dimensional structure including a first planar surface, a second planar surface, and a third planar surface, said surfaces intersecting to define a concave vortex point and thereby further defining internal and external sides of each said planar surface;

a plurality of transmitting and receiving antennas disposed on the internal side of one planar surface of said three-dimensional structure;

a plurality of radio frequency signal amplifying electronic circuit chips coupled to each of said antennas; and a power source connected with each of said electronic circuit chips.

2. The portable, pocket carried, active, high gain radio frequency corner reflecting apparatus as in claim 1, wherein said transmitting and receiving antennas comprise a microstrip element.

3. The portable, pocket carried, active, high gain radio frequency corner reflecting apparatus as in claim 2, wherein said microstrip element comprises a dipole antenna.

4. The portable, pocket carried, active, high gain radio frequency corner reflecting apparatus as in claim 2, wherein said antenna includes element dimensions no greater than 1.5 cm.

5. The portable, pocket carried, active, high gain radio frequency corner reflecting apparatus as in claim 1 wherein said electronic circuit chips are superregenerative amplifiers providing a gain of more than 80 dB.

6. The portable, pocket carried, active, high gain radio frequency corner reflecting apparatus as in claim 5, wherein said superregenerative amplifier comprises an active oscillating device and a quenching circuit coupled thereto for periodically turning the oscillator on and off.

7. The portable, pocket carried, active, high gain radio frequency corner reflecting apparatus as in claim 6, wherein said active oscillating device is an IMPATT diode.

8. The portable, pocket carried, active, high gain radio frequency corner reflecting apparatus as in claim 6, wherein said active oscillating device is an oscillator capable of producing operating frequencies of greater than 10 GHz.

9. The portable, pocket carried, active, high gain radio frequency corner reflecting apparatus as in claim 1, wherein said electronic circuit chip is disposed on an external side of said planar surface and coupled to said antenna therethrough.

10. The portable, pocket carried, active, high gain radio frequency corner reflecting apparatus as in claim 1, wherein said planar surfaces further comprises a ground plane on said external sides coupled to said antenna therethrough.

11. An active, high gain radio frequency corner reflecting apparatus comprising:

a first planar surface, a second planar surface, a third planar surface, said surfaces intersecting to define a concave vortex point and further defining internal and external sides of each said planar surface;

a plurality of transmitting and receiving antennas disposed on an internal side of one of said planar surfaces said antennas each comprising a microstrip elemented dipole;

a plurality of superregenerative amplifier integrated circuit chips disposed on said external side of said planar surfaces and coupled to said transmitting and receiving antennas therethrough;

a battery connected with each of said superregenerative amplifiers; and a grounding plane on said external side of said planar surfaces intermediate said antenna elements and said integrated circuit chips.

12. A high gain, corner reflecting method for actively reflecting radio frequency signals comprising the steps of:

assembling a collapsible corner reflector element from a folded state into its assembled state;

receiving an input radio frequency signal at an antenna member located on a first corner reflector planar surface of said collapsible corner reflector element;

communicating said input radio frequency signal between a plurality of corner reflector planar surfaces of said collapsible corner reflector element;

amplifying said input radio frequency signal using an amplifying electronic circuit chip disposed on at least one of said planar surfaces of said collapsible corner reflector element;

transmitting said amplified signal in the opposite direction from which it was received through an antenna coupled to said amplifying electronic circuit chip.

* * * * *